US007188406B2

(12) United States Patent
Varkey et al.

(10) Patent No.: US 7,188,406 B2
(45) Date of Patent: Mar. 13, 2007

(54) METHODS OF MANUFACTURING ENHANCED ELECTRICAL CABLES

(75) Inventors: Joseph P. Varkey, Missouri City, TX (US); Byong Jun Kim, Sugar Land, TX (US)

(73) Assignee: Schlumberger Technology Corp., Sugarland, TX (US)

( * ) Notice: Subject to any disclaimer, the term of this patent is extended or adjusted under 35 U.S.C. 154(b) by 28 days.

(21) Appl. No.: 11/118,953

(22) Filed: Apr. 29, 2005

(65) Prior Publication Data

US 2006/0242824 A1 Nov. 2, 2006

(51) Int. Cl.
*H01R 43/00* (2006.01)

(52) U.S. Cl. ..... 29/825; 29/33 M; 29/828; 174/104; 219/698; 264/1.28

(58) Field of Classification Search ..... 29/825, 29/828, 868, 33 F, 33 M, 745; 174/70 R, 174/71 C, 102 R, 102, 103, 104, 107, 105 R, 174/120 R, 131 A; 219/698, 693; 264/1.28, 264/1.29; 427/508; 156/47, 51
See application file for complete search history.

(56) References Cited

U.S. PATENT DOCUMENTS

| | | | | | |
|---|---|---|---|---|---|
| 3,634,607 | A | * | 1/1972 | Coleman | 174/120 R |
| 3,643,054 | A | * | 2/1972 | Forster | 219/699 |
| 4,486,252 | A | * | 12/1984 | Lloyd | 156/51 |
| 4,523,804 | A | | 6/1985 | Thompson | 350/96.23 |
| 4,979,795 | A | | 12/1990 | Mascarenhas | 350/96.23 |
| 5,329,605 | A | | 7/1994 | Wargotz | 385/107 |
| 5,431,759 | A | | 7/1995 | Neuroth | 156/53 |
| 6,030,255 | A | | 2/2000 | Konishi et al. | 439/578 |
| 6,060,662 | A | | 5/2000 | Rafie et al. | 174/106 |
| 6,195,487 | B1 | | 2/2001 | Anderson et al. | 385/101 |
| 6,403,889 | B1 | | 6/2002 | Mehan et al. | 174/120 |
| 6,555,752 | B2 | | 4/2003 | Dalrymple et al. | 174/102 |
| 6,600,108 | B1 | | 7/2003 | Mydur et al. | 174/120 |

OTHER PUBLICATIONS

S.M. Lebedev, O.S. Gefle, Yu.P.Pokholkov and V.I. Chichikin, "The Breakdown Strength of Two-Layer Dielectrics", Tomsk Polytechnic University, Tomsk, Russia #4.304.P2, High Voltage Engineering Symposium, Aug. 22-27, 1999.

M.M.A. Salama, R.Hackam, Fellow and A.Y. Chikhani, Sr., "Instructional Design of Multi-Layer Insulation of Power Cables", Transaction on Power Systems, vol. 7, No. 1, Feb. 1992, pp. 377-382.

U.S. Appl. No. 11/033698—Enhanced Electrical Cables filed Jan. 12, 2005.

* cited by examiner

*Primary Examiner*—Minh Trinh
*Assistant Examiner*—Donghai D. Nguyen
(74) *Attorney, Agent, or Firm*—David Cote; Tim Curington; Bill Batzer

(57) ABSTRACT

Disclosed are methods of manufacturing electrical cables. In one embodiment of the invention, method for manufacturing a wellbore cable includes providing at least one insulated conductor, extruding a first polymeric material layer over the insulated conductor, serving a first layer of armor wires around the polymeric material and embedding the armor wires in the first polymeric material by exposure to an electromagnetic radiation source, followed by and extruding a second polymeric material layer over the first layer of armor wires embedded in the first polymeric material layer. Then, a second layer of armor wires may be served around the second polymeric material layer, and embedded therein by exposure to an electromagnetic radiation source. Finally, a third polymeric layer may be extruded around the second layer of armor wires to form a polymeric jacket.

13 Claims, 8 Drawing Sheets

METHODS OF MANUFACTURING ENHANCED ELECTRICAL CABLES

BACKGROUND OF THE INVENTION

1. Field of the Invention

This invention relates to methods of manufacturing electric cables, as well as cables and the use of cables manufactured by such methods. In one aspect, the invention relates to a method of manufacturing durable and sealed torque balanced enhanced electric cables used with wellbore devices to analyze geologic formations adjacent a wellbore.

2. Description of the Related Art

Generally, geologic formations within the earth that contain oil and/or petroleum gas have properties that may be linked with the ability of the formations to contain such products. For example, formations that contain oil or petroleum gas have higher electrical resistivity than those that contain water. Formations generally comprising sandstone or limestone may contain oil or petroleum gas. Formations generally comprising shale, which may also encapsulate oil-bearing formations, may have porosities much greater than that of sandstone or limestone, but, because the grain size of shale is very small, it may be very difficult to remove the oil or gas trapped therein. Accordingly, it may be desirable to measure various characteristics of the geologic formations adjacent to a well before completion to help in determining the location of an oil- and/or petroleum gas-bearing formation as well as the amount of oil and/or petroleum gas trapped within the formation.

Logging tools, which are generally long, pipe-shaped devices, may be lowered into the well to measure such characteristics at different depths along a wellbore in a subterranean formation. These logging tools may include gamma-ray emitters/receivers, caliper devices, resistivity-measuring devices, neutron emitters/receivers, and the like, which are used to sense characteristics of the formations adjacent the well. A wellbore electric cable connects the logging tool with one or more electrical power sources and data analysis equipment at the earth's surface, as well as providing structural support to the logging tools as they are lowered and raised through the well. Generally, the cable is spooled out of a truck over a pulley, and down into the well.

Electric cables are commonly formed from a combination of metallic conductors, insulative material, filler materials, jackets, and metallic armor wires. Commonly, the useful life of a wellbore electric cable is typically limited to only about 6 to 24 months, as the cable may be compromised by exposure to extremely corrosive elements, or little or no maintenance of cable strength members, such as armor wires. A common factor limiting cable life is armor wire failure, where fluids present in the downhole wellbore environment lead to corrosion and failure of the armor wires.

Armor wires are typically constructed of cold-drawn pearlitic steel coated with zinc for corrosion protection. While zinc protects the steel at moderate temperatures, it is known that corrosion is readily possible at elevated temperatures and certain environmental conditions. Although the cable core may still be functional, it is generally not economically feasible to replace the armor wire, and the entire cable must be discarded. Once corrosive fluids infiltrate into the annular gaps, it is difficult or impossible to completely remove them. Even after the cable is cleaned, the corrosive fluids remain in interstitial spaces damaging the cable. As a result, cable corrosion is essentially a continuous process which may begin with the wireline cable's first trip into the well. Once the armor wire begins to corrode, strength is quickly lost, and the entire cable must be replaced. Armor wires in wellbore electric cables are also associated with several operational problems including torque imbalance between armor wire layers, difficult-to-seal uneven outer profiles, and loose or broken armor wires.

In wells with surface pressures, the electric cable is run through one or several lengths of piping packed with grease, also known as flow tubes, to seal the gas pressure in the well while allowing the wireline to travel in and out of the well. Because the armor wire layers have unfilled annular gaps or interstitial spaces, dangerous gases from the well can migrate into and travel through these gaps upward toward lower pressure. This gas tends to be held in place as the wireline travels through the grease-packed piping. As the cable goes over the upper sheave at the top of the piping, the armor wires may spread apart, or separate slightly, and the pressurized gas released, where it becomes a fire or explosion hazard. Further, while the cables with two layers of armor wires are under tension, the inner and outer armor wires, generally cabled at opposite lay angles, rotate slightly in opposite directions causing torque imbalance problems. To create a torque-balanced cable, inner armor wires would have to be somewhat larger than outer armor wires, but the smaller outer wires would quickly fail due to abrasion and exposure to corrosive fluids. Therefore, larger armor wires are placed at the outside of the wireline cable, which results in torque imbalance.

Armored wellbore cables may also wear due to point-to-point contact between armor wires. Point-to-point contact wear may occur between the inner and outer armor wire layers, or oven side-to-side contact between armor wires in the same layer. While under tension and when cables go over sheaves, radial loading causes point loading between outer and inner armor wires. Point loading between armor wire layers removes the zinc coating and cuts groves in the inner and outer armor wires at the contact points. This may cause strength reduction, lead to premature corrosion, and may even accelerate cable fatigue failure. Also, due to annular gaps or interstitial spaces between the inner armor wires and the cable core, as the wireline cable is under tension the cable core materials tend to creep thus reducing cable diameter and causing linear stretching of the cable as well as premature electrical shorts.

It is commonplace that as wellbore electrical cables are lowered into unobstructed wells, the tool string rotates to relieve torque in the cable. When the tool string becomes stuck in the well (for example, at an obstruction, or at a bend in a deviated well) the cable tension is typically cycled until the cable can continue up or down the hole. This bouncing motion creates rapidly changing tension and torque, which can cause several problems. The sudden changes in tension can cause tension differentials along the cables length, causing the armor wires to "birdcage." Slack cable can also loop around itself and form a knot in the wireline cable. Also, for wellbore cables, it is a common solution to protect armor wire by "caging." In caging designs, a polymer jacket is applied over the outer armor wire. A jacket applied directly over a standard outer layer of armor wires, which is essentially a sleeve. This type of design has several problems, such as, when the jacket is damaged, harmful well fluids enter and are trapped between the jacket and the armor wire, causing corrosion, and since damage occurs beneath the jacket, it may go unnoticed until a catastrophic failure.

Also, during wellbore operations, such as logging, in deviated wells, wellbore cables make significant contact with the wellbore surface. The spiraled ridges formed by the cables' armor wire commonly erode a groove in the side of the wellbore, and as pressure inside the well tends to be higher than pressure outside the well, the cable is prone to stick into the formed groove. Further, the action of the cable contacting and moving against the wellbore wall may remove the protective zinc coating from the armor wires, causing corrosion at an increased rate, thereby reducing the cable life.

Electric cables, and methods of manufacturing such cables, that improve some or all of the problems described above, while being capable of conducting larger amounts of power with significant data signal transmission capability would be highly desirable, and the need is met at least in part by the following invention.

BRIEF SUMMARY OF THE INVENTION

In one aspect of the invention, methods of manufacturing electrical cables are provided. In one embodiment of the invention, a method for manufacturing a wellbore electric cable, the method includes providing at least one insulated conductor, extruding a first polymeric material layer over the insulated conductor, serving a first layer of armor wires around the polymeric material and embedding the armor wires in the first polymeric material by exposure to an electromagnetic radiation source, followed by and extruding a second polymeric material layer over the first layer of armor wires embedded in the first polymeric material layer. Then, a second layer of armor wires may be served around the second polymeric material layer, and embedded therein by exposure to an electromagnetic radiation source. Finally, a third polymeric layer may be extruded around the second layer of armor wires to form a polymeric jacket. The polymeric material may be a polyolefin, polyamide, polyurethane, thermoplastic polyurethane, polyaryletherether ketone, polyaryl ether ketone, polyphenylene sulfide, polymers of ethylene-tetrafluoroethylene, polymers of poly(1,4-phenylene), polytetrafluoroethylene, perfluoroalkoxy polymers, fluorinated ethylene propylene, perfluoromethoxy polymers, ethylene chloro-trifluoroethylene (such as Halar®), chlorinated ethylene propylene, and any mixtures thereof, and may further include wear resistance particles or even reinforcing short and/or milled fibers. The cable formed may be a monocable, a quadcable, a heptacable, a quadcable, or a coaxial cable, and used in wellbore or seismic operations. Also, the method may be utilized to form insulated stranded conductors useful to make cables.

Another embodiment of the invention discloses a method for manufacturing a wellbore electric cable including providing a cable core, wherein the cable core comprises six insulated conductors helically served about one central insulated conductor, then extruding a first polymeric material layer over the cable core. Next, a first layer of armor wires is served around the polymeric material layer and embedding the armor wires in the first polymeric material by exposure to an electromagnetic radiation source, and extruding a second polymeric material layer over the first layer of armor wires embedded in the first polymeric material layer. Finally, a second layer of armor wires may be served around the second polymeric material layer and embedding the armor wires by exposure to an electromagnetic radiation source, and extruding a third polymeric layer around the second layer of armor wires wherein the third polymeric material forms a polymeric jacket around the second layer of armor wires.

In cables produced according to methods of the invention, the polymeric materials forming the polymeric layers may be chemically and/or mechanically bonding with one another.

BRIEF DESCRIPTION OF THE DRAWINGS

The invention may be understood by reference to the following description taken in conjunction with the accompanying drawings.

DETAILED DESCRIPTION OF THE INVENTION

Figure 1:
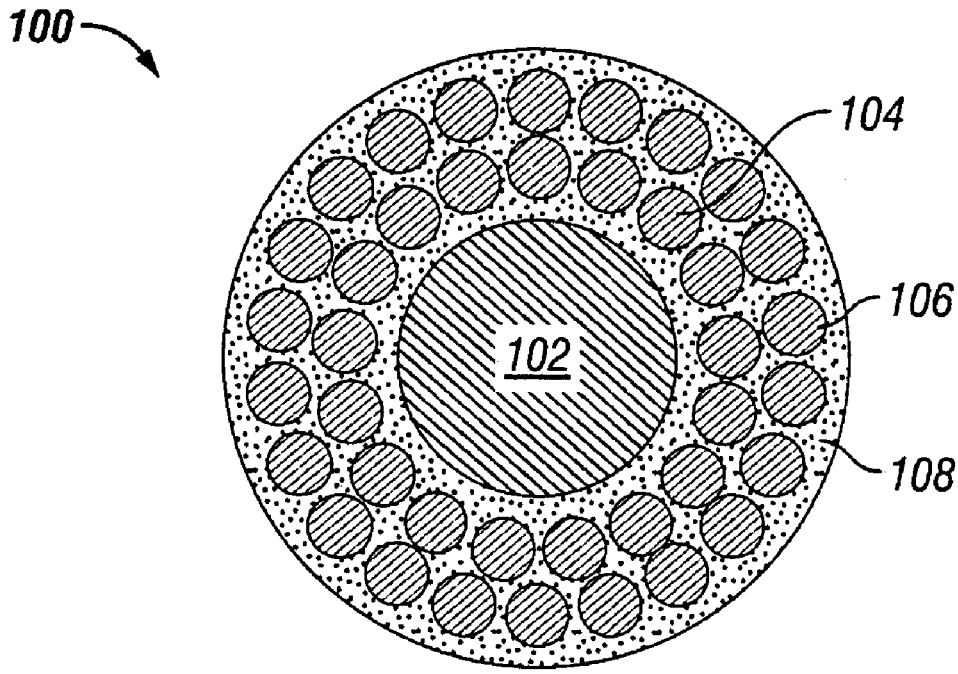
FIG. 1 is stylized a cross-sectional generic representation of cables according to the invention.

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

The invention relates to methods of manufacturing electric cables, as well as cables and the use of cables manufactured by such methods. In one aspect, the invention relates to a method of manufacturing durable and sealed torque balanced enhanced electric cable used with wellbore devices to analyze geologic formations adjacent a wellbore. Methods according to the invention utilize an electromagnetic radiation source, or a series of electromagnetic sources, during cable manufacture. Cables produced by methods according to the invention described herein are enhanced and provide such benefits as wellbore gas migration and escape prevention, as well as torque-resistant cables with durable jackets that resist stripping, bulging, cut-through, corrosion, and abrasion. Such cables include continuous polymer layers, with no significant interstitial spaces. In the case of armored cables, the cable may include a polymeric material extending from the cable core to the cable's outer circumference, while maintaining a high percentage of coverage by the armor wire layers. The polymeric material encapsulates the armor wires and virtually eliminates any significant interstitial spaces between armor wires and polymeric material that might serve as conduits for gas migration.

It has been unexpectedly discovered that by using an electromagnetic radiation source(s) (for example, infrared waves) to partially melt or soften the polymeric material very soon after each armor wire layer is applied over a polymeric material layer increases the achieved coverage, from about 93 to about 98% after exposure to electromagnetic radiation, while the armor wire is at served significantly lower coverage (for example 80% to 85%). This approach enables the armor wires to embed in the polymeric material, thus locking the armor wires in place and virtually eliminating any significant interstitial spaces.

The methods of the invention may be used for producing any electrical and/or data transmitting cables including, but not necessarily limited to, telecommunication cables, electrical transmission cables, instrument cables, optical fiber cables, insulated stranded conductors, insulated conductors, served shield conductors, and wellbore cables such as monocables, coaxial cables, heptacables, seismic cables, slickline cables, multiline cables, and the like. The methods may also be applied to insulated conductors to provide gas-blocking abilities. In the case of coaxial cables, this approach may be effective to maintain isolation between the coaxially served conductors and out armor wire layer(s).

Protecting armor wires with durable jacket materials that contiguously extend from the cable core to a smooth outer jacket provides an excellent sealing surface, is torque balanced, and significantly reduces drag. Operationally, cables prepared by the methods according to the invention help improve the problems of fires or explosions due to wellbore gas migration and escape between the armor wires, birdcaging, stranded armors, armor wire milking due to high armor, and looping and knotting, and are also stretch-resistant, crush-resistant as well as resistant to material creep and differential sticking.

Cables prepared by the methods of the invention generally include at least one insulated conductor, least one layer of armor wires surrounding the insulated conductor, and a polymeric material disposed in the interstitial spaces formed between armor wires and the interstitial spaces formed between the armor wire layer and insulated conductor. The armor wires are generally helically positioned around the insulated conductors. Conductors may be either helically positioned, or positioned centrally upon the center axis of the cable. Insulated conductors useful in the embodiments of the invention include metallic conductors encased in an insulated jacket. Any suitable metallic conductors may be used. Examples of metallic conductors include, but are not necessarily limited to, copper, nickel coated copper, or aluminum. Preferred metallic conductors are copper conductors. While any suitable number of metallic conductors may be used in forming the insulated conductor, preferably from 1 to about 60 metallic conductors are used, more preferably 7, 19, or 37 metallic conductors. Insulated jackets may be prepared from any suitable materials known in the art. Examples of suitable insulated jacket materials include, but are not necessarily limited to, polytetrafluoroethylene-perfluoromethylvinylether polymer (MFA), perfluoroalkoxyalkane polymer (PFA), polytetrafluoroethylene polymer (PTFE), ethylene-tetrafluoroethylene polymer (ETFE), ethylene-propylene copolymer (EPC), poly(4-methyl-1-pentene) (TPX® available from Mitsui Chemicals, Inc.), other polyolefins, other fluoropolymers, polyaryletherether ketone polymer (PEEK), polyphenylene sulfide polymer (PPS), modified polyphenylene sulfide polymer, polyether ketone polymer (PEK), maleic anhydride modified polymers, Parmax® SRP polymers (self-reinforcing polymers manufactured by Mississippi Polymer Technologies, Inc based on a substituted poly (1,4-phenylene) structure where each phenylene ring has a substituent R group derived from a wide variety of organic groups), or the like, and any mixtures thereof.

In some embodiments of the invention, the insulated conductors are stacked dielectric insulated conductors, with electric field suppressing characteristics, such as those used in the cables described in U.S. Pat. No. 6,600,108 (Mydur, et al.), hereinafter incorporated by reference. Such stacked dielectric insulated conductors generally include a first insulating jacket layer disposed around the metallic conductors wherein the first insulating jacket layer has a first relative permittivity, and, a second insulating jacket layer disposed around the first insulating jacket layer and having a second relative permittivity that is less than the first relative permittivity. The first relative permittivity is within a range of about 2.5 to about 10.0, and the second relative permittivity is within a range of about 1.8 to about 5.0.

At least one layer of armor wires surrounding the insulated conductor may be used in cables of the invention. The armor wires may be generally made of any high tensile strength material including, but not necessarily limited to, galvanized improved plow steel, alloy steel, or the like. In preferred embodiments of the invention, cables comprise an inner armor wire layer surrounding the insulated conductor and an outer armor wire layer served around the inner armor wire layer. A protective polymeric coating may be applied to each strand of armor wire for corrosion protection or even to promote bonding between the armor wire and the polymeric material disposed in the interstitial spaces. As used herein, the term bonding is meant to include chemical bonding, mechanical bonding, or any combination thereof. Examples of coating materials which may be used include, but are not necessarily limited to, fluoropolymers, fluorinated ethylene propylene (FEP) polymers, ethylene-tetrafluoroethylene polymers (Tefzel®), perfluoro-alkoxyalkane polymer (PFA), polytetrafluoroethylene polymer (PTFE), polytetrafluoroethylene-perfluoromethylvinylether polymer (MFA), polyolefin, polyamide, polyurethane, thermoplastic polyurethane, polyaryletherether ketone polymer (PEEK), or polyether ketone polymer (PEK) with fluoropolymer combination, polyphenylene sulfide polymer (PPS), PPS and PTFE combination, latex or solid rubber coatings, and the like. Each armor wire may also be plated with materials for corrosion protection or even to promote bonding between the armor wire and polymeric material. Nonlimiting examples of suitable plating materials include brass, copper alloys, and the like. Plated armor wires may even be cords such as tire cords. While any effective thickness of plating or coating material may be used, a thickness from about 10 microns to about 100 microns is preferred.

Polymeric materials are disposed in the interstitial spaces formed between armor wires, and interstitial spaces formed between the armor wire layer and insulated conductor. While the current invention is not particularly bound by any specific functioning theories, it is believed that disposing a polymeric material throughout the armor wires interstitial spaces, or unfilled annular gaps, among other advantages, prevents dangerous well gases from migrating into and traveling through these spaces or gaps upward toward regions of lower pressure, where it becomes a fire, or even explosion hazard. In cables according to the invention, the armor wires are partially or completely sealed by a polymeric material that completely fills all interstitial spaces, therefore eliminating any conduits for gas migration. Further, incorporating a polymeric material in the interstitial spaces provides torque balanced armored cables, since the outer armor wires are locked in place and protected by a tough polymer jacket, and larger diameters are not required in the outer layer, thus mitigating torque balance problems. Additionally, since the interstitial spaces filled, corrosive downhole fluids cannot infiltrate and accumulate between the armor wires. The polymeric material may also serve as a filter for many corrosive fluids. By minimizing exposure of the armor wires and preventing accumulation of corrosive fluids, the useful life of the cable may be significantly greatly increased.

Also, filling the interstitial spaces between armor wires and separating the inner and outer armor wires with a polymeric material reduces point-to-point contact between the armor wires, thus improving strength, extending fatigue life, while avoiding premature armor wire corrosion. Because the interstitial spaces are filled the cable core is completely contained and creep is mitigated, and as a result, cable diameters are much more stable and cable stretch is significantly reduced. The creep-resistant polymeric materials used in this invention may minimize core creep in two ways: first, locking the polymeric material and armor wire layers together greatly reduces cable deformation; and secondly, the polymeric material may also help eliminate any annular spaces into which the cable core might otherwise creep. Cables according to the invention may improve problems encountered with caged armor designs, since the polymeric material encapsulating the armor wires may be continuously bonded it cannot be easily stripped away from the armor wires. Because the processes used in this invention allow standard armor wire coverage (93–98% metal) to be maintained, cable strength may not be sacrificed in applying the polymeric material, as compared with typical caged armor designs.

The polymeric materials useful in the cables produced by methods according to the invention include, by nonlimiting example, polyolefin (such as EPC or polypropylene), other polyolefins, polyamide, polyurethane, thermoplastic polyurethane, polyaryletherether ketone (PEEK), polyaryl ether ketone (PEK), polyphenylene sulfide (PPS), modified polyphenylene sulfide, polymers of ethylene-tetrafluoroethylene (ETFE), polymers of poly(1,4-phenylene), polytetrafluoroethylene (PTFE), perfluoroalkoxy (PFA) polymers, fluorinated ethylene propylene (FEP) polymers, polytetrafluoroethylene-perfluoromethylvinylether (MFA) polymers, Parmax®, ethylene chloro-trifluoroethylene (such as Halar®), chlorinated ethylene propylene, and any mixtures thereof. Preferred polymeric materials are ethylene-tetrafluoroethylene polymers, perfluoroalkoxy polymers, fluorinated ethylene propylene polymers, and polytetrafluoroethylene-perfluoromethylvinylether polymers.

The polymeric material may be disposed contiguously from the insulated conductor to the outermost layer of armor wires, or may even extend beyond the outer periphery thus forming a polymeric jacket that completely encases the armor wires. The polymeric material forming the jacket and armor wire coating material may be optionally selected so that the armor wires are not bonded to and can move within the polymeric jacket. The polymeric materials forming the polymeric layers may be chemically and/or mechanically bonding with one another as well. In some instances, the polymeric material layers may be chemically and/or mechanically bonded contiguously from the innermost layer to the outermost layer.

In some embodiments of the invention, the polymeric material may not have sufficient mechanical properties to withstand high pull or compressive forces as the cable is pulled, for example, over sheaves, and as such, may further include reinforcing fibers or particles. While any suitable fibers or particles may be used to provide properties sufficient to withstand such forces, examples include, but are not necessarily limited to, reinforcing short and/or milled fibers, reinforcing short and/or milled carbon fibers, nano-carbon fibers, nano-carbon particles, carbon fibers, glass fibers, ceramic fibers, Kevlar® fibers, Vectran® fibers, quartz, or any other suitable material. The fibers, such as carbon fibers, may be incorporated in sufficient quantities to facilitate or enhance the softening or melting of the polymeric material upon exposure to electromagnetic radiation. Further, as the friction for polymeric materials including reinforcing short and/or milled fibers may be significantly higher than that of the polymeric material alone, an outer jacket of polymeric material without reinforcing short and/or milled fibers may be placed around the outer periphery of the cable so the outer surface of cable has low friction properties.

The polymeric material used to form the polymeric jacket or the outer jacket may also include reinforcing particles which improve cable wear resistance as it is deployed in wellbores. Examples of suitable particles include Ceramer™ (polyphenylene dulfone based additive), boron nitride, PTFE, graphite, nanoparticles (such as nanoclays, nanosilicas, nanocarbons, nanocarbon fibers, or other suitable nanomaterials), or any combination of the above.

One or more armor wires may be replaced with coated armor wires. The coating may be comprised of the same material as those polymeric materials described hereinabove. This may help improve torque balance by reducing the strength, weight, or even size of the outer armor wire layer, while also improving the bonding of the polymeric material to the outer armor wire layer.

In some embodiments of the invention, cables produced by methods of the invention may comprise at least one filler rod component in the armor wire layer. In such cables, one or more armor wires are replaced with a filler rod component, which may include bundles of synthetic long fibers or long fiber yarns. The synthetic long fibers or long fiber yams may be coated with any suitable polymers, including those polymeric materials described hereinabove. The polymers may be extruded over such fibers or yams to promote bonding with the polymeric jacket materials. This may further provide stripping resistance. Also, as the filler rod components replace outer armor wires, torque balance between the inner and outer armor wire layers may further be enhanced.

As described above, cables produced in accordance with the invention may be of any practical design, including such wellbore cables monocables, coaxial cables, quadcables, heptacables, slickline cables, multiline cables, and the like. In coaxial cable designs of the invention, a plurality of metallic conductors surround the insulated conductor, and are positioned about the same axis as the insulated conductor. Also, for any cables of the invention, the insulated conductors may further be encased in a tape. All materials, including the tape disposed around the insulated conductors, may be selected so that they will bond chemically and/or mechanically with each other. Cables of the invention may have any outer diameter suitable to form the cable, preferably from about 0.5 mm to about 400 mm, and more preferably from about 1 mm to about 100 mm.

The materials forming the insulating layers and the polymeric materials used in the cables may further include a fluoropolymer additive, or fluoropolymer additives, in the material admixture to form the cable. Such additive(s) may be useful to produce long cable lengths of high quality at high manufacturing speeds. Suitable fluoropolymer additives include, but are not necessarily limited to, polytetrafluoroethylene, perfluoroalkoxy polymer, ethylene tetrafluoroethylene copolymer, fluorinated ethylene propylene, perfluorinated poly(ethylene-propylene), and any mixture thereof. The fluoropolymers may also be copolymers of tetrafluoroethylene and ethylene and optionally a third comonomer, copolymers of tetrafluoroethylene and vinylidene fluoride and optionally a third comonomer, copolymers of chlorotrifluoroethylene and ethylene and optionally a third comonomer, copolymers of hexafluoropropylene and ethylene and optionally third comonomer, and copolymers of hexafluoropropylene and vinylidene fluoride and optionally a third comonomer. The fluoropolymer additive should have a melting peak temperature below the extrusion processing temperature, and preferably in the range from about 200° C. to about 350° C. To prepare the admixture, the fluoropolymer additive is mixed with the insulating jacket or polymeric material. The fluoropolymer additive may be incorporated into the admixture in the amount of about 5% or less by weight based upon total weight of admixture, preferably about 1% by weight based or less based upon total weight of admixture, more preferably about 0.75% or less based upon total weight of admixture.

Cables prepared according to the invention may include armor wires employed as electrical current return wires which provide paths to ground for downhole equipment or tools. The invention enables the use of armor wires for current return while minimizing electric shock hazard. In some embodiments, the polymeric material isolates at least one armor wire in the first layer of armor wires thus enabling their use as electric current return wires.

The invention is not limited, however, to providing cables having only metallic conductors. Optical fibers may be used in order to transmit optical data signals to and from the device or devices attached thereto, which may result in higher transmission speeds, lower data loss, and higher bandwidth. The term conductor as used herein is meant to indicate either metallic or optical fiber conductors, unless otherwise indicated.

Methods according to the invention utilize an electromagnetic radiation source, or a series of electromagnetic sources, which provide electromagnetic waves, during cable manufacture to melt or soften, in whole or part, polymeric materials which are in contact, or layered, with cable wire components as solid conductors, stranded conductors, armor wires, and the like. Electromagnetic radiation may be provided by any suitable means, including, but not necessarily limited to, infrared heaters emitting short, medium, or long infrared waves, microwaves, light amplification by stimulated emission of radiation (LASER), ultrasonic waves, and the like, or any combination thereof. Preferably the electromagnetic radiation is supplied from infrared heaters emitting short, medium, or long infrared waves, and combinations thereof.

In methods of the invention, wire components, such as helical conductor strands, served shielded wires, armor wires, and the like, are cabled onto polymer-encased central elements, such as central conductor strands, insulated conductors, cable cores, and the like, at a given coverage. Soon after the wire or conductor component comes in contact with the insulation or polymeric material encasement it is served upon, the cabled product passes through an electromagnetic radiation source, which slightly melts and/or softens the insulation or polymeric material, allowing the cabled wires or conductors to embed. As the cabled wires or conductors embed, they achieve a greater coverage at a smaller circumference.

To illustrate, in the case of a monocable, served shielded wires might be cabled onto a central insulated conductor at a coverage between about 80 and about 85%. The term "coverage", as used herein, represents the percent ratio of the sum of diameters of wires being served upon a circular surface (such as a cable core or insulated conductor) relative to the diameter of that circular surface. For example, if a cable core has a diameter of 10 mm, and the sum of diameters of all armor wires being served in a layer around the cable core is 8.2 mm, then the coverage is 82%. Within a short distance after the served wires or conductors are in contact with the insulated conductor or cable core, the cable passes through an electromagnetic radiation source to soften and/or melt the insulation or polymeric material, causing the served wires or conductors to embed in the insulation or polymeric material. The served wires or conductors embed due to the compressive force exerted during the cable process by the wires or conductors on the softened and/or melted insulation or polymeric material. The excess length of the wire or conductor is taken up due to slowing of the feed rate of the individual wires or conductors. Because the wire components may now be distributed around a smaller circumference, coverage increases to between about 93% and about 98%.

As an illustrated example of improved coverage, a monocable is assembled by serving two layers of 0.82 mm diameter armor wires at a 22-degree lay angle over a polymeric jacketed cable core with an initial diameter of 3.15 mm. The total initial diameter is 3.97 mm. Upon exposure to electromagnetic radiation, the polymeric jacket is then softened to allow the armor wire to partially embed into the jacket, such that the resulting total diameter is 3.59 mm. As described in the calculations following, the length of armor wire required to wrap around the core at the 22 degree lay angle is 10.16% shorter at the smaller cable diameter. Over a 7,500 meter length monocable, this is a difference of approximately 760 meter for each armor wire. Such a length savings may not be removed after the armor wiring step had been completed. Hence, complete filling of the interstitial spaces is almost impossible, thus keeping the wire or conductor coverage the about the same after the cable is armored over long lengths.

Coverage and excess length equations and calculations for the monocable example described immediately above are as follows:

---

D = Pitch Diameter
$D = D_c + d_w$
$D_c$ = Cable Core Diameter
$d_w$ = Diameter of Armor Wire
m = Number of Metal Elements
$D_a$ = Initial Diameter
$D_b$ = Final Diameter
$\lambda$ = Length of One Armor Wire Wrap
$\lambda = (\pi \times \text{diameter})/\tan 22$
$C_1$ = Total Circumferance at Pitch Diameter
$C_1 = \pi \times (D_c + d_w) = \pi \times D$
$C_2$ = Total Metal Circumferance at Pitch Diameter
$C_2 = m \times d_w/\cos \alpha$
$C_{\%}$ = Metal Coverage at Pitch Diameter
$C_{\%} = (m \times d_w/\pi \times D \times \cos \alpha) \times 100$
$\lambda_a$ = Length of One Wrap of Armor Wire at $D_a$
$\lambda_b$ = Length of One Wrap of Armor Wire at $D_b$
$\alpha$ = Lay Angle
$D_a$ = 3.15 mm + 0.82 mm (initial core + 1st armor wire layer) = 3.97 mm
$\lambda_a = (\pi \times 3.97 \text{ mm})/\tan 22 = 30.99$ mm
$D_b$ = 2.77 mm + 0.82 mm (final core + 1st armor wire layer) = 3.59 mm
$\lambda_b = (\pi \times 3.59 \text{ mm})/\tan 22 = 27.84$ mm
% Difference in Lay Angle Length as a Fraction of $\lambda_a$ = $((\lambda_a - \lambda_b)/\lambda_a) \times 100\%$, or $((30.99 - 27.84)/30.99) \times 100\% = 10.16\%$

---

The methods described herein are only possible because the excess length is taken up by tension at the armor wire spools as the diameter is reduced. The rate of speed of payoff of the armor wire from a spool source is slowed to account for the excess length "going back" to the spool.

Referring now to FIG. 1, a cross-sectional generic representation of some cables produced by methods according to the invention. The cables include a core 102 which comprises insulated conductors in such configurations as heptacables, monocables, coaxial cables, slickline cables, multiline cables, or even quadcables. A polymeric material 108 is contiguously disposed in the interstitial spaces formed between armor wires 104 and 106, and interstitial spaces formed between the armor wires 104 and core 102. The polymeric material 108 may further include reinforcing short and/or milled fibers. The inner armor wires 104 are evenly spaced when cabled around the core 102. The armor wires 104 and 106 may be coated armor wires as described herein above. The polymeric material 108 may extend beyond the outer armor wires 106 to form a polymeric jacket thus forming a polymeric encased cable 100.

Figure 2:
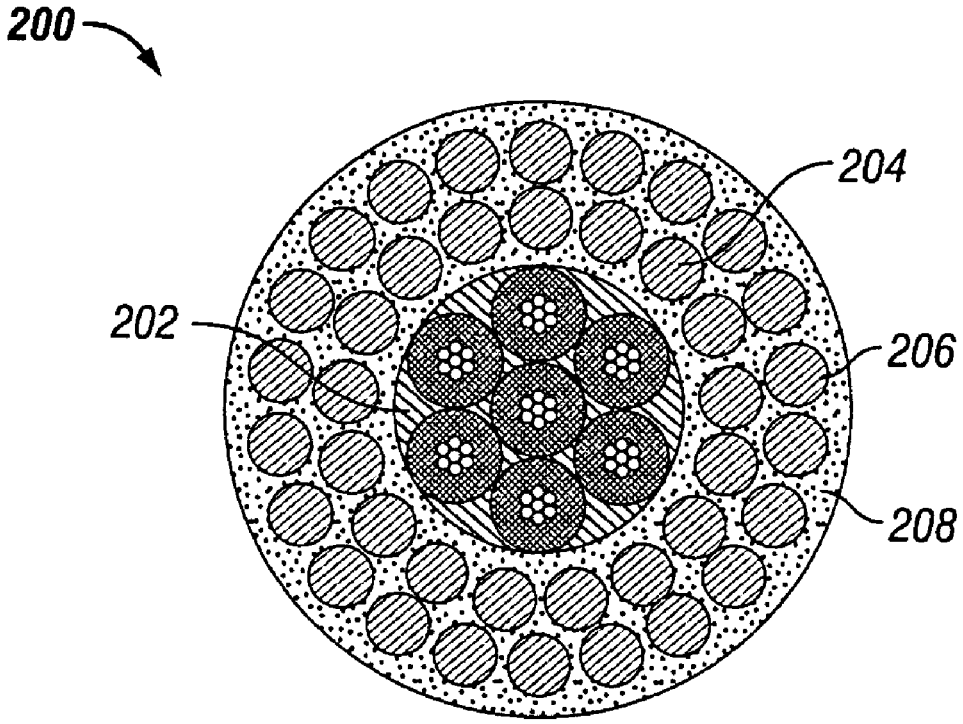
FIG. 2 is a stylized cross-sectional representation of a heptacable according to the invention.
Figure 3:
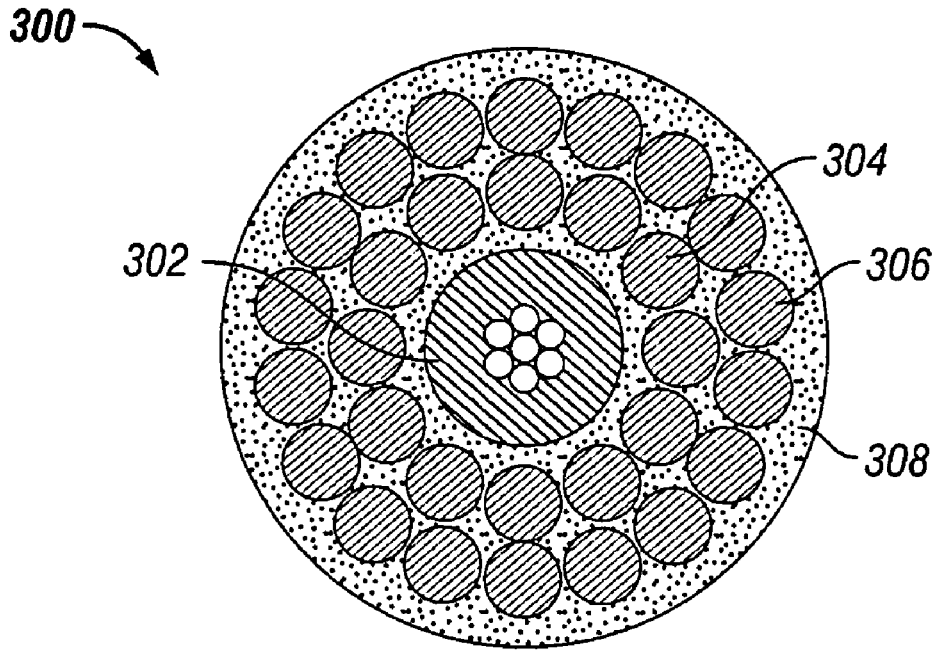
FIG. 3 is a stylized cross-sectional representation of a monocable according to the invention.

FIG. 2, illustrates a cross-sectional representation of a heptacable produced according to the invention. Similar to cable 100 illustrated in FIG. 1, the heptacable includes a core 202 comprised of seven insulated conductors in a heptacable configuration. A polymeric material 208 is contiguously disposed in the interstitial spaces formed between armor wires 204 and 206, and interstitial spaces formed between the armor wires 204 and heptacable core 202. The armor wires 204 and 206 may be coated armor wires as well. The polymeric material 208 may extend beyond the outer armor wires 206 to form a sealing polymeric jacket. Another cable manufactured by methods of the invention is shown in FIG. 3, which is a cross-sectional representation of a monocable. The cable includes a monocable core 302, a single insulated conductor, which is surrounded with a polymeric material 308. The single insulated conductor is comprised of seven metallic conductors encased in an insulated jacket. The polymeric material is disposed about in the interstitial spaces formed between inner armor wires 304 and outer armor wires 306, and interstitial spaces formed between the inner armor wires 304 and insulated conductor 302. The polymeric material 308 may extend beyond the outer armor wires 306 to form a sealing polymeric jacket.

Figure 4:
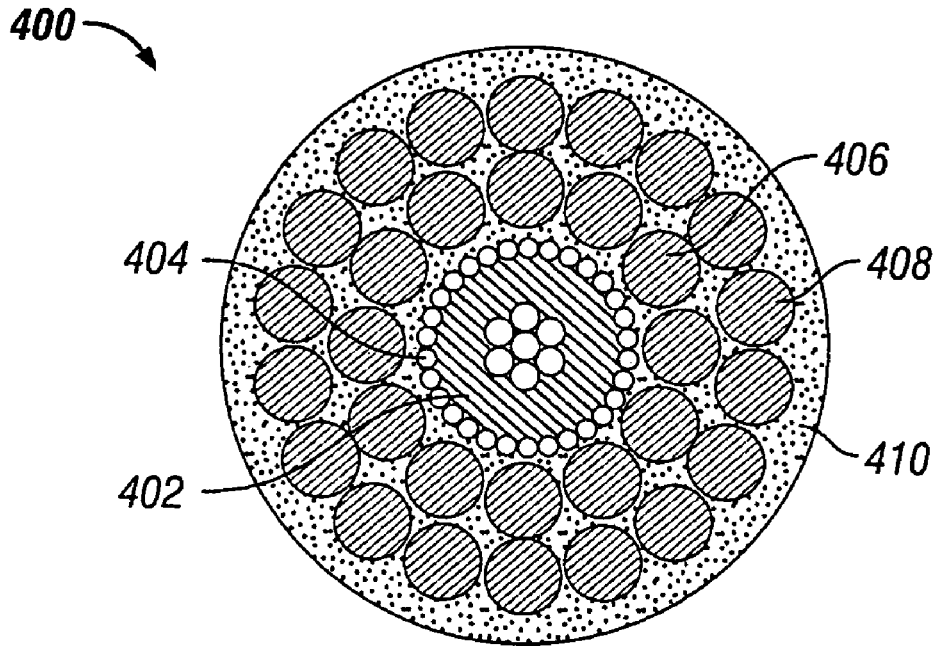
FIG. 4 is a stylized cross-sectional representation of a coaxial cable according to the invention.

FIG. 4 illustrates yet another cable embodiment prepared according to the invention, which is a coaxial cable. This embodiment includes an insulated conductor 402 at the core similar to the monocable insulated conductor 302 shown in FIG. 3. A plurality of metallic conductors 404 surround the insulated conductor, and are positioned about the same axis as the insulated conductor 402. A polymeric material 410 is contiguously disposed in the interstitial spaces formed between armor wires 406 and 408, and interstitial spaces formed between the armor wires 406 and plurality of metallic conductors 404. The inner armor wires 406 are evenly spaced. The armor wires 406 and 408 may be coated armor wires. The polymeric material 410 may extend beyond the outer armor wires 408 to form a polymeric jacket thus encasing and sealing the cable 400.

Figure 5:
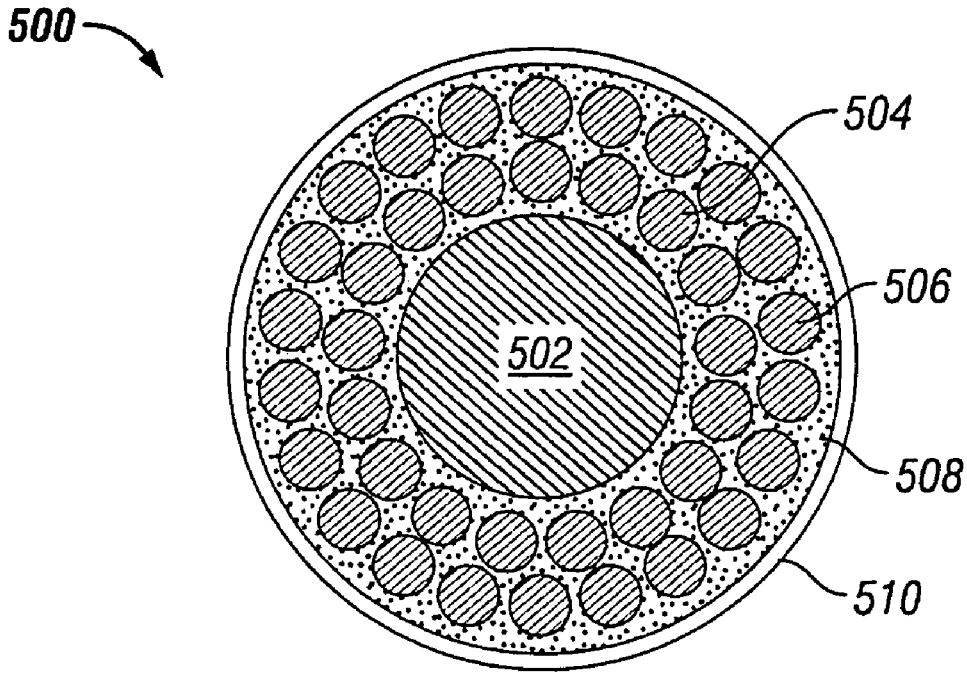
FIG. 5 is a cross-section illustration of a cable according to the invention which comprises a outer jacket formed from a polymeric material and where the outer jacket surrounds a polymeric material layer that includes reinforcing short and/or milled fibers.

In cable embodiments prepared according to the invention where the polymeric material extends beyond the outer periphery to form a polymeric jacket completely encasing the armor wires, the polymeric jacket is formed from a polymeric material as described above, and may further comprise reinforcing short and/or milled fibers and/or particles. Referring now to FIG. 5, a cable comprising an outer jacket, the cable 500 is comprised of a at least one insulated conductor 502 placed in the core position, a polymeric material 508 contiguously disposed in the interstitial spaces formed between armor wire layers 504 and 506, and interstitial spaces formed between the armor wires 504 and insulated conductor(s) 502. The polymeric material 508 extends beyond the outer armor wires 506 to form a polymeric jacket. The cable 500 further includes an outer jacket 510, which is bonded with polymeric material 508, and encases polymeric material 508, armor wires 504 and 506, as well as insulated conductor(s) 502. The outer jacket 510 is formed from a polymeric material, free of any fiber, but may contain particles as described hereinabove, so the outer surface of cable has low friction properties. Further, the polymeric material 508 may contain reinforcing short and/or milled fibers to impart creep resistance, toughness, and strength in the cable.

Figure 6:
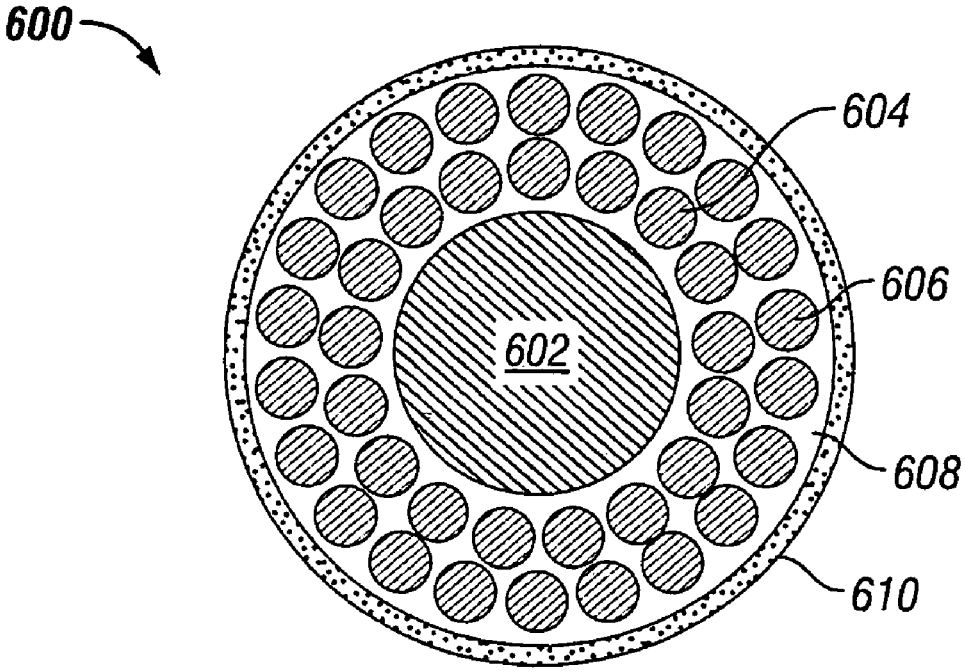
FIG. 6 is a cross-sectional representation of a cable of the invention, which has an outer jacket formed from a polymeric material including reinforcing short and/or milled fibers, and where the outer jacket surrounds a polymeric material layer.

FIG. 6 illustrates yet another embodiment of a cable prepared according to the invention, which has a polymeric jacket including short fibers. Cable 600 includes at least one insulated conductor 602 in the core, a polymeric material 608 contiguously disposed in the interstitial spaces formed between armor wire layers 604 and 606, and interstitial spaces formed between the armor wires 604 and insulated conductor(s) 602. The polymeric material 608 may extend beyond the outer armor wires 606 to form a polymeric jacket. The cable 600 includes an outer jacket 610, bonded with polymeric material 608, and encasing the cable. The outer jacket 610 is formed from a polymeric material that also includes reinforcing short and/or milled fibers. The polymeric material 608 may optionally be free of any reinforcing short and/or milled fibers or particles.

Figure 7:
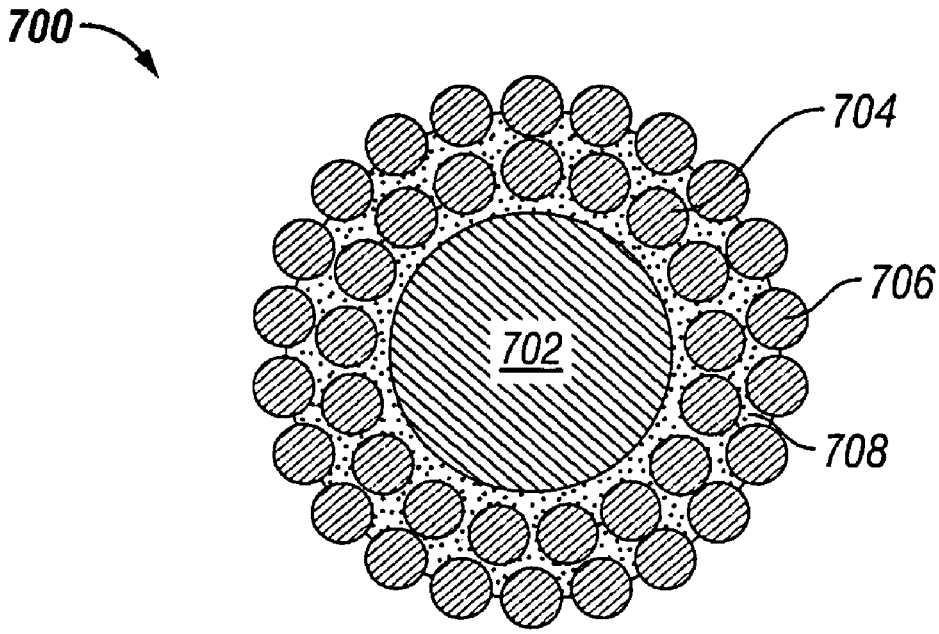
FIG. 7 is a cross-section illustration of a cable according to the invention which includes a polymeric material partially disposed about the outer armor wires.

In some cables, the polymeric material may not necessarily extend beyond the outer armor wires. Referring to FIG. 7, which illustrates a cable with polymeric material partially disposed about the outer armor wires, the cable 700 has at least one insulated conductor 702 at the core position, a polymeric material 708 disposed in the interstitial spaces formed between armor wires 704 and 706, and interstitial spaces formed between the inner armor wires 704 and insulated conductor(s) 702. The polymeric material is not extended to substantially encase the outer armor wires 706.

Figure 8:
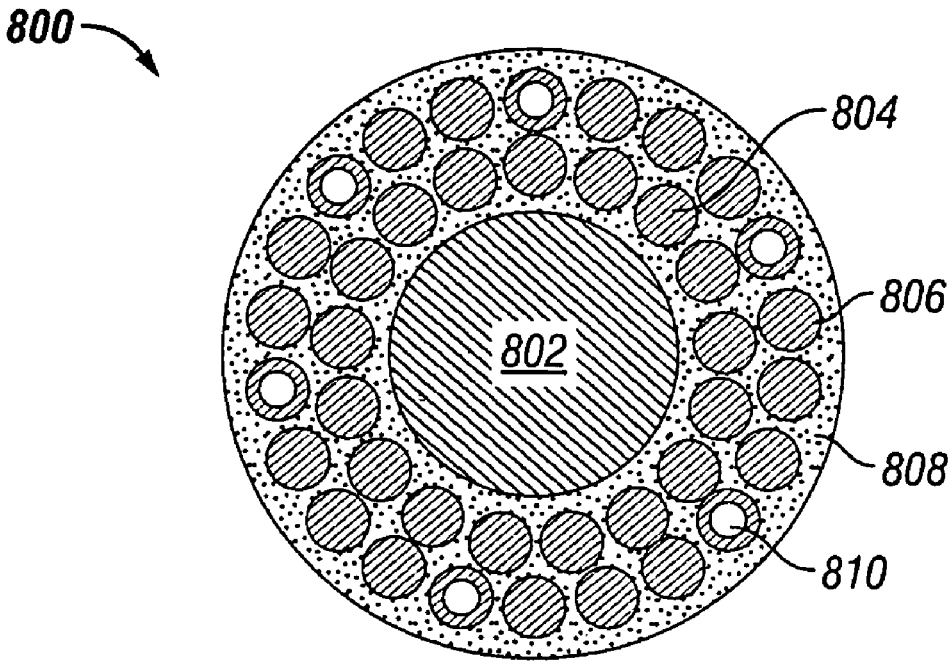
FIG. 8 is a cross section which illustrates a cable which includes coated armor wires in the outer armor wire layer.

Coated armor wires may be placed in either the outer and inner armor wire layers, or both. Including coated armor wires, wherein the coating is a polymeric material as mentioned hereinabove, may improve bonding between the layers of polymeric material and armor wires. The cable represented in FIG. 8 illustrates a cable that includes coated armor wires in the outer armor wire layer. Cable 800 has at least one insulated conductor 802 at the core position, a polymeric material 808 disposed in the interstitial spaces formed between armor wires 804 and 806, and interstitial spaces formed between the inner armor wires 804 and insulated conductor(s) 802. The polymeric material is extended to substantially encase the outer armor wires 806. The cable further comprises coated armor wires 810 in the outer layer of armor wires.

Figure 9:
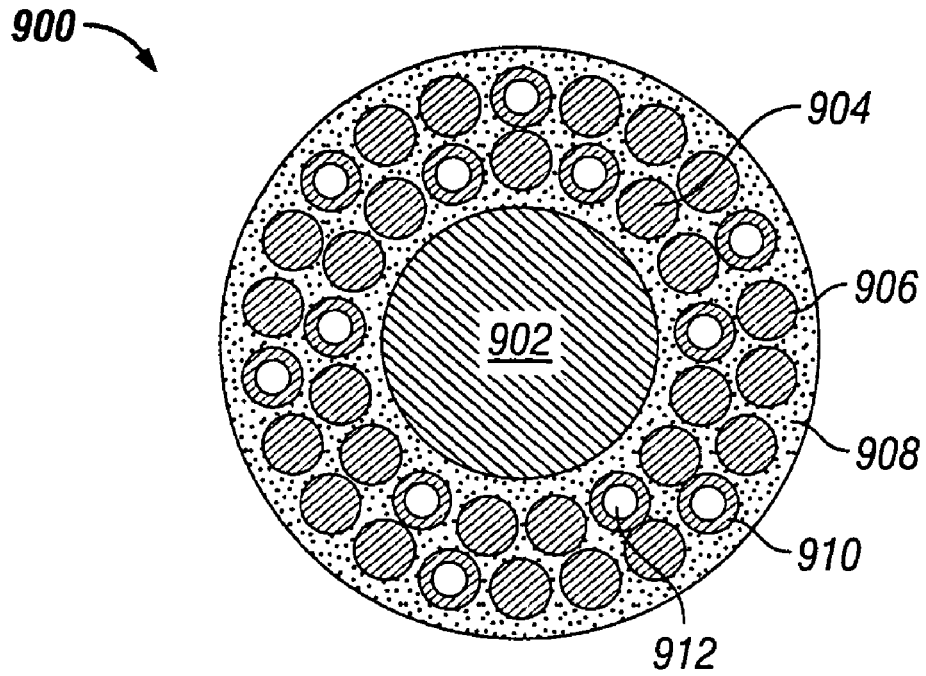
FIG. 9 is a cross section which illustrates a cable which includes a coated armor wires in the inner and outer armor wire layers.

Referring to FIG. 9, a cable that includes coated armor wires in both inner and outer armor wire layers, 910 and 912. Cable 900 is similar to cable 800 illustrated in FIG. 8, comprising at least one insulated conductor 902 at the core position, a polymeric material 908 disposed in the interstitial spaces formed between armor wires 904 and 906, and the interstitial spaces formed between the inner armor wires 904 and insulated conductor 902. The polymeric material is extended to substantially encase the outer armor wires 906 to form a polymeric jacket thus encasing and sealing the cable 900.

Figure 10:
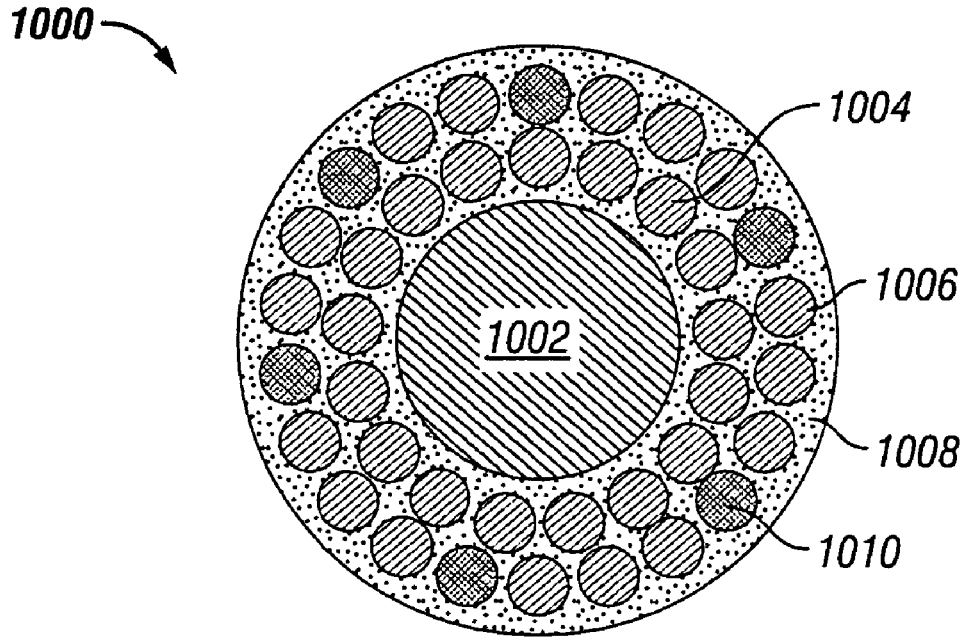
FIG. 10 is a cross section illustrating a cable which includes filler rod components in the outer armor wire layer.

Referring to FIG. 10, a cable which includes filler rod components in the armor wire layer. Cable 1000 includes at least one insulated conductor 1002 at the core position, a polymeric material 1008 disposed in the interstitial spaces formed between the inner armor wires 1004 and 1006, and the interstitial spaces formed between the inner armor wires 1004 and insulated conductor 1002. The polymeric material 1008 is extended to substantially encase the outer armor wires 1006, and the cable further includes filler rod components 1010 in the outer layer of armor wires. The filler rod components 1010 include a polymeric material coating which may further enhance the bond between the filler rod components 1010 and polymeric material 1008.

Figure 11:
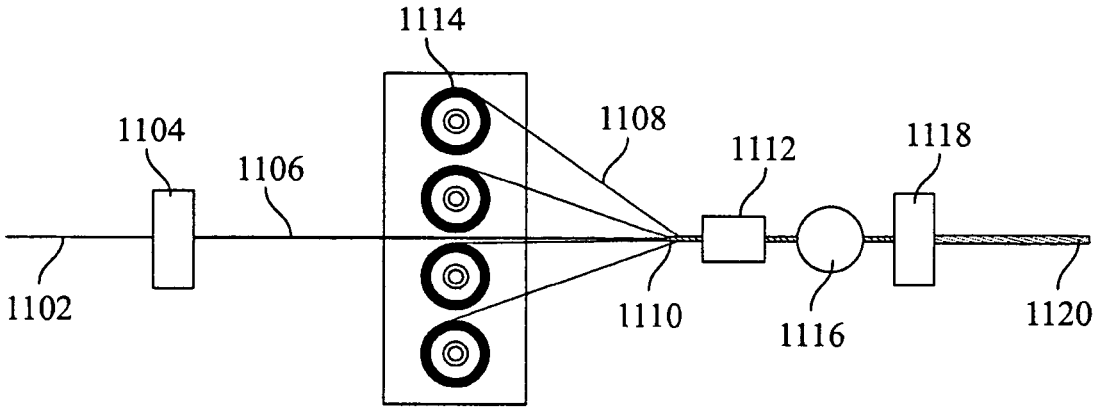
FIG. 11 is an illustration of one method for producing cables according to the invention.

Referring now to FIG. 11, which is an illustration of one method for producing cables or insulated stranded conductors according to the invention. In FIG. 11, the method begins by compression or tube extruding an inner layer of insulating material or polymeric material over a conductor 1102 using an extruder 1104 to prepare an insulated conductor 1106. One or more conductors, or armor wires, 1108 (only one indicated) may then be cabled around the insulated conductor 1106 at a specific lay angle, at 1110. Within a few centimeters or meters after the conductors, or armor wires, 1108 are applied, the conductor is exposed to an electromagnetic radiation source 1112 to slightly melt or soften the insulation or polymeric material. Excess length created, as the conductor or wires 1108 embed in the slightly melted or softened material, transfers back to the spools 1114 (only one indicated) due to tension in individual conductors or wires 1108. To improve contact between helical conductors or wires 1108 and insulated conductor 1106, as well as to maintain a consistent O.D., one of any suitable techniques may be used at point 1116.

Figure 12:
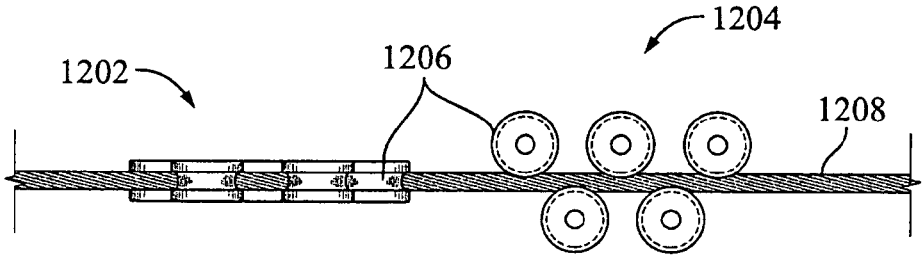
FIG. 12 is an illustration of a first technique used in methods of producing cables for improving contact between conductors/wires and insulated conductors, as well as to maintain a consistent outer diameter.
Figure 13A:
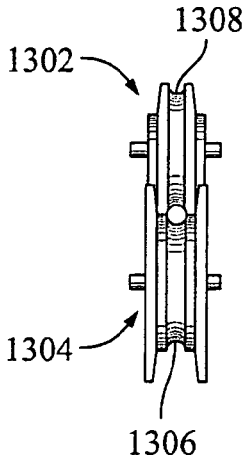
FIG. 13A and FIG. 13B illustrate of a second technique used in methods of producing cables for improving contact between conductors/wires and insulated conductors, as well as to maintain a consistent outer diameter.
Figure 13B:
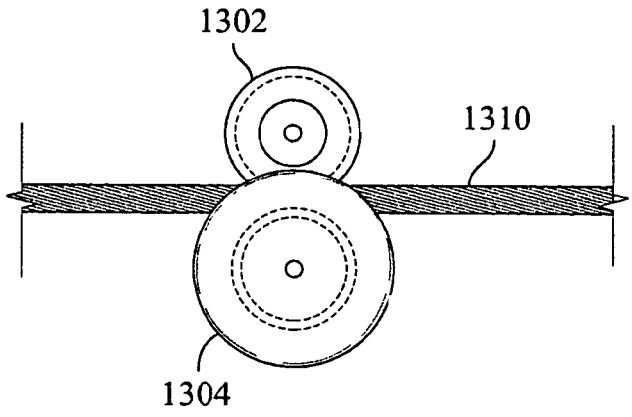

A first technique shown in FIG. 12, utilizes two series of adjustable rollers, 1202 and 1204, which are offset by about 90 degrees. As shown in FIG. 12, precisely sized grooves 1206 in the rollers press the cabled metal components 1208 evenly into the softened insulating or polymer material, resulting in a firmly contacted and embedded conductor or wire with a uniform O.D. In another technique, illustrated in FIG. 13A and FIG. 13B, after cabling the helical conductors or wires 1108 onto the insulated conductor 1106, the combination 1106 and 1108 passes through a pair of shaping wheels 1302 and 1304 with mated surfaces and grooves 1306 and 1308 which uniformly embed the cabled metal components 1310 and set the O.D. to the desired size.

Referring again to FIG. 11, after the contact between conductors or wires 1108 and insulated conductor 1106 is improved as well as O.D. set at point 1116, an outer layer of insulation or polymeric material may then be compression extruded at 1118 over the combination of conductors or wires 1108 and insulated conductor 1106, to form cable 1120. The mechanical communication between the inner insulation or polymeric material layer and the conductors or wires 1108 allows the outer layer of insulation to be compression-extruded without causing any damage to or milking of the conductors or wires 1108. This method is useful to produce cables or insulated stranded conductors.

Figure 14:
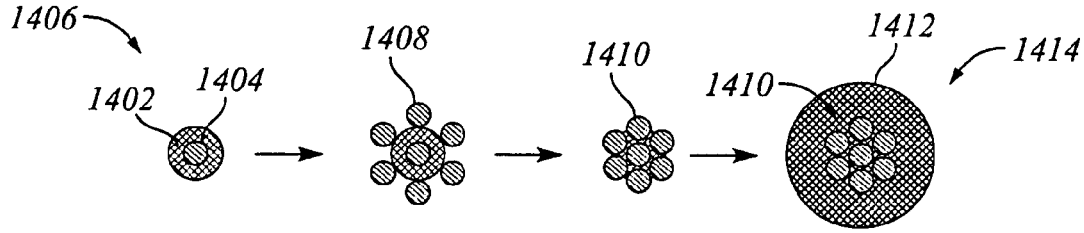
FIG. 14 illustrates by cross-section, the step-by-step formation of an insulated conductor produced by the methods illustrated in FIGS. 11, 12, 13A, and 13B.

FIG. 14 illustrates by cross-section, the step-by-step formation of an insulated conductor produced by the methods illustrated in FIGS. 11, 12, 13A, and 13B. An inner layer of insulating material 1402 is extruded over a conductor 1404 using an extruder to prepare an insulated conductor 1406. One or more conductors, 1408 (only one indicated) are cabled around the insulated conductor 1406 at a specific lay angle. After the conductors, 1408 are applied, the combination 1406 and 1408 is exposed to an electromagnetic radiation source, where the conductors 1408 embed in the slightly melted or softened material, to provide conductor 1410. An outer layer of insulation material 1412 may then be extruded over cable 1410 resulting in an insulated conductor 1414.

The method illustrated in FIG. 11 may be used to prepare an interstitial filled insulated conductor which may be used as a component in larger cables, or even to prepare a jacketed cable. When used to prepare an insulated conductor, the method may be performed on a separate production line with the insulated conductor spooled for use in a second production line that produces a polymeric material jacketed cable.

Figure 15:
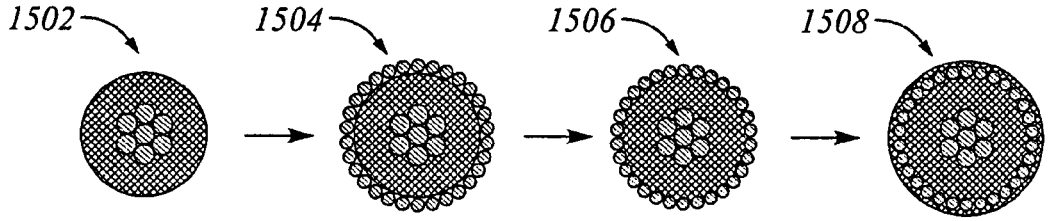
FIG. 15 illustrates by cross-section, the step-by-step formation of an insulated coaxial conductor produced by the methods illustrated in FIGS. 11, 12, 13A, and 13B.

The method illustrated in FIG. 11 may also be effective in forming a jacketed coaxial cable. As shown in FIG. 15, the process of FIG. 11 may be effective when providing an insulated conductor 1502 (similar to 1414 in FIG. 14) and serving a layer of coaxial conductors 1504 (only one indicated) thereupon, exposing the combination of insulated conductor 1502 and coaxial conductors 1504 to an electromagnetic radiation source, thus embedding the coaxial conductors 1504 in the slightly melted or softened insulating material, to provide the coaxial conductor 1506. In a further step, the embedded coaxial conductors 1504 may then have another layer of insulating or polymeric material extruded thereupon to form a jacketed coaxial conductor or cable 1508. Lastly, at least one layer of armor wires may be served over the jacketed coaxial conductor or cable 1508. Such layer, or layers, of armor wires may also be cabled by the method described in FIG. 11 to form a jacketed armored cable. This process allows the complete filling of the interstitial spaces between conductors 1502 and coaxial conductors 1506 and spaces between the coaxial conductors 1506 and jacket 1508.

For some cables produced according to the invention, armor wires are cabled over a cable core encased in a polymeric jacket, then the jacket is softened through exposure to an electromagnetic radiation source, allowing the armor wires to partially embed into the jacket and allowing the melted polymer to flow between the armor wires and fill interstitial spaces formed between armor wires and between the armor wires and cable core.

Figure 16:
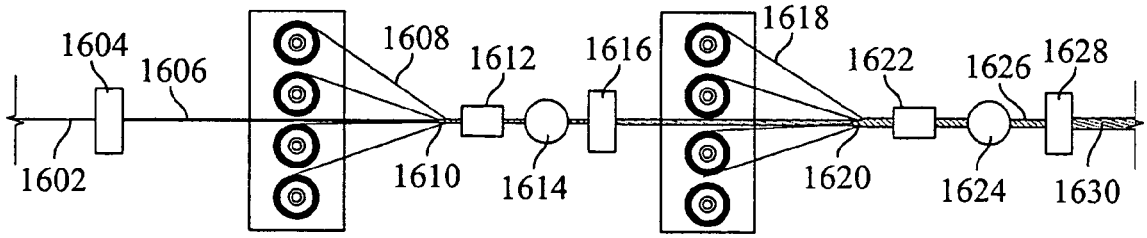
FIG. 16 illustrates a method of producing cables which includes armor wire layers embedded in a polymeric material, and optionally, jacketed by a polymeric material.

FIG. 16 illustrates a method of producing cables which includes armor wire layers embedded in a polymeric material, and optionally, jacketed by such material. The method begins by providing a cable core 1602 which may be an insulated conductor such as 1414 in FIG. 14, a plurality of such insulated conductors 1414, a jacketed coaxial conductor or cable 1508 shown in FIG. 15, or even a stacked dielectric insulated conductor. In the case of using a plurality of insulated conductors 1414, a particular useful configuration is six insulated conductors helically served around a central insulated conductor to form a heptacable. Referring again to FIG. 16, cable core 1602 has a compression or tube extruded layer of polymeric material thereover using extruder 1604 to prepare an polymer jacketed core 1606. Armor wires 1608 (only one indicated) are then cabled around the polymer jacketed core 1606 at a specific lay angle, at point 1610. Within a few centimeters or meters the combined polymer jacketed core 1606 and armor wires 1608 is exposed to an electromagnetic radiation source 1612 to slightly melt or soften the polymeric material, which in turn, embeds the armor wires 1608. To improve contact between polymer jacketed core 1606 and armor wires 1608, as well as to maintain a consistent O.D., one of any suitable techniques may be used at point 1614, for example the techniques taught in FIG. 12, FIG. 13A, and FIG. 13B. The combined and embedded polymer jacketed core 1606 and armor wires 1608 may then have another layer of polymeric material extruded thereon at point 1616, followed by a second layer of armor wires 1618 (only one indicated) served thereon at point 1620. Then, this combination is exposed to an electromagnetic radiation source 1622 to slightly melt or soften the polymeric material applied at point 1616, which in turn, embeds armor wire layers 1608 and 1618 in the polymeric material. Then the combination passes through device 1624 to maintain a consistent O.D. and improve contact, and forming the armored cable 1626. In a final step, the armored cable 1626 may have a compression or tube extruded layer of polymeric material thereon using extruder 1628, to form a jacketed armored cable 1630.

Figure 17:
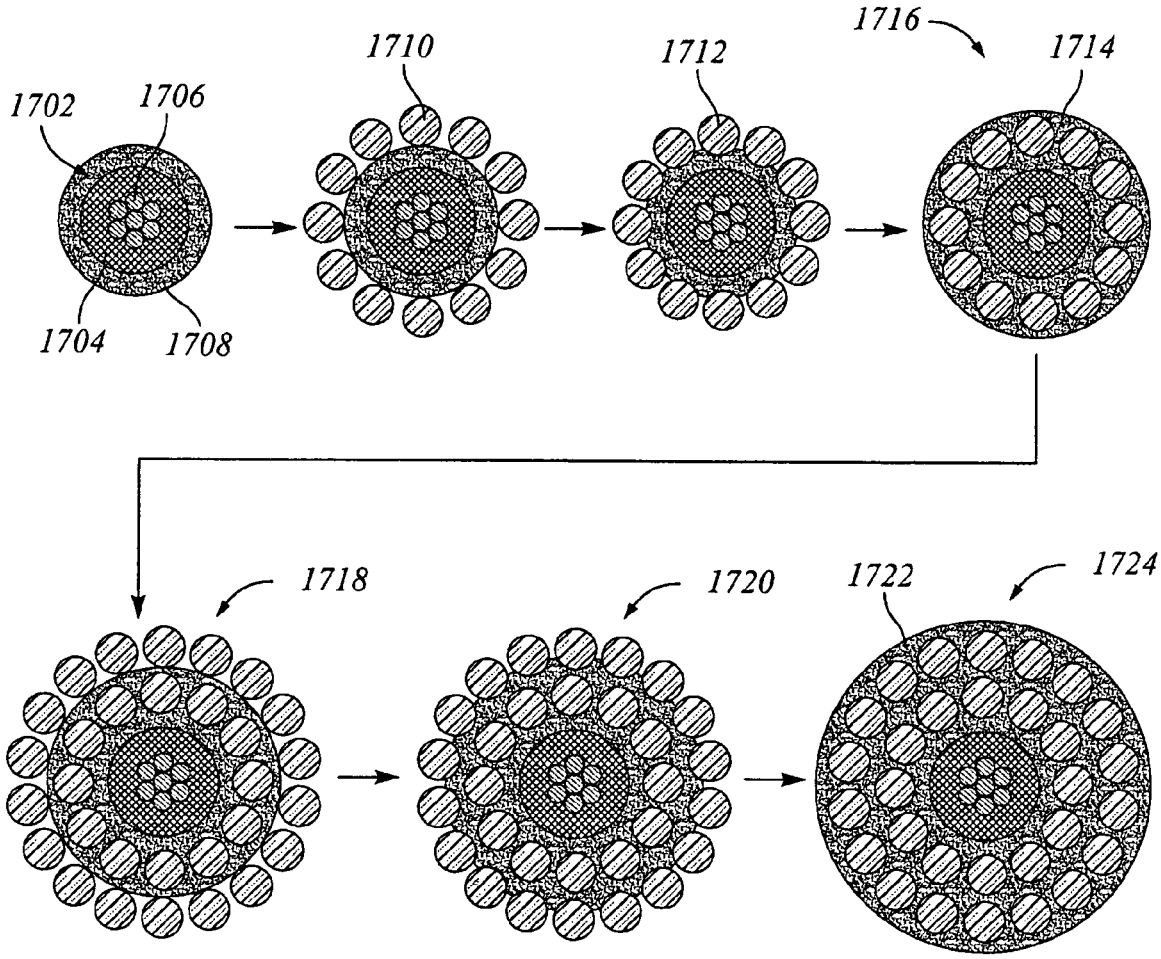
FIG. 17 illustrates by cross-section, the step-by-step formation of a jacketed armored monocable produced by the methods illustrated in FIGS. 16, 12, 13A, and 13B.

FIG. 17 illustrates by cross-section, the step-by-step formation of a jacketed armor cable produced by the methods illustrated in FIGS. 16, 12, 13A, and 13B. In this illustration, the process begins by providing an insulated conductor or cable core 1702, which may be any insulated conductor, including the conductor 1414 shown in FIG. 14, the coaxial insulated conductor 1508 shown in FIG. 15, a stacked dielectric insulated conductor, or even a cable core including a plurality of such insulated conductors. In the case of using a plurality of insulated conductors, a particular useful configuration is six insulated conductors helically served around a central insulated conductor to form a heptacable. An insulated conductor may include an insulating material 1704 disposed around at least one metallic conductor 1706. An insulated conductor or cable core 1702 has a polymeric material 1708 disposed thereupon. A first layer of armor wires 1710 (only one indicated) is then cabled around the insulated conductor or cable core 1702 coated with polymeric material 1708 at a specific lay angle. This combination is exposed to an electromagnetic radiation source, and device such as those illustrated in FIG. 12 or FIG. 13A/13B to maintain a consistent O.D. and improve contact to form the embedded armored cable 1712. A layer of polymeric material 1714 is then disposed upon the embedded armored cable 1712, to form jacketed cable 1716. A second layer of armor wires 1718 (only one indicated) may then be cabled around the jacketed cable 1716 at a specific lay angle. This combination is then exposed to an electromagnetic radiation source, and device such as those illustrated in FIG. 12 or FIG. 13A/13B to maintain a consistent O.D. and improve contact to form the armored cable 1720. A last layer of polymeric material 1722 may then be disposed upon armored cable 1720 to form the jacketed armored cable 1724.

Any methods illustrated above or according to the invention may also incorporate exposure to a series of electromagnetic radiation sources after a first polymeric material is extruded and armor wire or conductor served, and before extruding a second polymeric material layer over the first layer of armor wires or conductors embedded in the first polymeric material layer. This may enable a stop or pause in the manufacture of the cable before extruding a second polymeric material layer over the first layer of armor wires or conductors. A similar pause could further be performed before extruding a third polymeric material layer over a second layer of armor wires, or conductors, embedded in the second polymeric material layer. Exposure of the cable to electromagnetic radiation within a few centimeters or meters before extruding a layer of polymeric material likely promotes bonding, mechanical and/or chemical, with previous extruded layers of polymeric material.

Methods of the invention may also be useful to form any useful cables, including gun cables for seismic exploration. In such a method, a first polymeric material layer is place over the gun cable core. Then a first layer of armor wires is served over the cable core encased in a polymeric material layer and the combination exposed to an electromagnetic radiation source. This combination then passes through a device such as those illustrated in FIG. 12 or FIG. 13A/13B to maintain a consistent O.D. and improve contact to form an embedded armored cable. A final polymeric material layer may then be disposed to form a jacketed armored gun cable for seismic exploration. This approach allows the lay angle to be fixed and helps prevent armor wire movement in subsequent processing or field use.

Cables prepared according to the invention may be used with wellbore devices to perform operations in wellbores penetrating geologic formations that may contain gas and oil reservoirs. The cables may be used to interconnect well logging tools, such as gamma-ray emitters/receivers, caliper devices, resistivity-measuring devices, seismic devices, neutron emitters/receivers, and the like, to one or more power supplies and data logging equipment outside the well. Cables of the invention may also be used in seismic operations, including subsea and subterranean seismic operations. The cables may also be useful as permanent monitoring cables for wellbores.

For wellbores with a potential well head pressure, flow tubes with grease pumped under pressure into the constricted region between the cable and a metallic pipe are typically used for wellhead pressure control. The number of flow tubes depends on the absolute wellhead pressure and the permissible pressure drop across the flow tube length. The grease pump pressure of the grease is typically 20% greater than the pressure at the wellhead. Some cables produced herein may enable use of pack off devices, such as by non-limiting example rubber pack-offs, as a friction seal to contain wellhead pressure, thus minimizing or eliminating the need for grease packed flow tubes. As a result, the cable rig up height on for pressure operations is decreased as well as down sizing of related well site surface equipment such as a crane/boom size and length. Also, the cables of the invention with a pack off device will reduce the requirements and complexity of grease pumps as well as the transportation and personnel requirements for operation at the well site. Further, as the use of grease imposes environmental concerns and must be disposed off based on local government regulations, involving additional storage/transportation and disposal, the use of cables of the invention may also result in significant reduction in the use of grease or its complete elimination.

Cables prepared according to the invention that have been spliced may be used at a well site. Since the traditional requirement to utilize metallic flow tubes containing grease with a tight tolerance as part of the wellhead equipment for pressure control may be circumvented with the use of friction seal pack off equipment, such tight tolerances may be relaxed. Thus, use of spliced cables at the well site may be possible.

As some cables produced by the invention are smooth, or slick, on the outer surface, frictional forces (both with WHE and cable drag) are significantly reduced as compared with similar sized armored logging cables. The reduced friction would make possible the ability to use less weight to run the cable in the wellbore and reduction in the possibility of vortex formation, resulting in shorter tool strings and additional reduction in the rig up height requirements. The reduced cable friction, or also known as cable drag, will also enhance conveyance efficiency in corkscrew completions, highly deviated, S-shaped, and horizontal wellbores.

As traditional armored cables tend to saw to ,cut into the wellbore walls due to their high friction properties, and increase the chances of differential pressure sticking ("key seating" or "differential sticking"), the cables prepared herein may help reduce the chances of differential pressure sticking since the slick outer surface may not easily cut into the wellbore walls, especially in highly deviated wells and S-shaped well profiles. The slick profile of the cables would reduce the frictional loading of the cable onto the wellbore hardware and hence potentially reduce wear on the tubulars and other well bore completion hardware (gas lift mandrels, seal bore's, nipples, etc.).

In some slickline and multiline cables produced by methods according to the invention, the need for metallic tubes in the cable design may be reduced or even eliminated. The slickline and multiline cables produced herein may include armor wire layers embedded and encased in a polymeric material, surrounding the cable core. The armor wires may be of any suitable diameter, preferably from about 0.5 mm to about 10 mm. An outer polymeric material jacket surrounding the armor wires may function to protect the wires from abrasion, provide sealing properties, and in the case of armor wire failure, contain the failed armor wires. This approach may also provide high strength slickline and multiline cables, which are improvements over traditional slickline and multiline cables generally utilizing low strength fatigue prone steel tubes. Steel tubes may still be effectively used in cables produced according to the invention as an alternate means for sealing the cable.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values. (of the form, "from about a to about b," or, equivalently, "from approximately a to b," or, equivalently, "from approximately a–b") disclosed herein is to be understood as referring to the power set (the set of all subsets) of the respective range of values. Accordingly, the protection sought herein is as set forth in the claims below.

We claim:

1. A method for manufacturing an electrical cable comprising:

(a) providing at least one insulated conductor;

(b) extruding a first polymeric material layer over the insulated conductor;

(c) serving a first layer of armor wires around the polymeric material and embedding the first layer of armor wires in the first polymeric material by exposure to an electromagnetic radiation source;

(d) extruding a second polymeric material layer over the first layer of armor wires embedded in the first polymeric material layer, wherein the first polymeric material layer is exposed to a second electromagnetic radiation source before extruding the second polymeric material layer over the first layer of armor wires, and wherein the first polymeric layer and second polymeric layer are bonded; and, (e) exposing the second polymeric material layer to a third electromagnetic radiation source and serving a second layer of armor wires over the second polymeric material layer, and then extruding a third polymeric material layer over the second layer of armor wires, wherein the polymeric layers are bonded.

2. The method according to claim 1 further comprising serving a second layer of armor wires around the second polymeric material layer and embedding the second layer of armor wires by exposure to an electromagnetic radiation source, and extruding a third polymeric layer around the second layer of armor wires wherein the third polymeric material forms a polymeric jacket around the second layer of armor wires.

3. The method according to claim 1 wherein the insulated conductor comprises a plurality of metallic conductors encased in an insulated jacket.

4. The method according to claim 3 wherein the insulated jacket comprises:

(a) a first insulating jacket layer disposed around the metallic conductors wherein the first insulating jacket layer has a first relative permittivity; and b) a second insulating jacket layer disposed around the first insulating jacket layer and having a second relative permittivity that is less than the first relative permittivity.

5. The method according to claim 4, wherein the first relative permittivity is within a range of about 2.5 to about 10.0, and wherein the second relative permittivity is within a range of about 1.8 to about 5.0.

6. The method according to claim 1 further comprising a plurality of metallic conductors surrounding the insulated conductor.

7. The method according to claim 1 wherein the first polymeric material layer and the second polymeric material layer are formed from a polymeric material selected from the group consisting of polyolefin, polyamide, polyurethane, thermoplastic polyurethane, polyaryletherether ketone, polyaryl ether ketone, polyphenylene sulfide, modified polyphenylene sulfide, polymers of ethylene-tetrafluoroethylene, polymers of poly(1,4-phenylene), polytetrafluoroethylene, perfluoroalkoxy, fluorinated ethylene propylene, chlorinated ethylene propylene, ethylene chloro-trifluoroethylene, polytetrafluoroethylene-perfluoromethylvinylether, and any mixtures thereof.

8. The method according to claim 1 wherein the first polymeric material layer and the second polymeric material layer are formed from a polymeric material which is an ethylene-tetrafluoroethylene polymer.

9. The method according to claim 1 wherein the first polymeric material layer and the second polymeric material layer are formed from a polymeric material which is a perfluoroalkoxy polymer.

10. The method according to claim 1 wherein the first polymeric material layer and the second polymeric material layer are formed from a polymeric material which is a polytetrafluoroethylene-perfluoromethylvinylether polymer.

11. The method according to claim 1 wherein the first polymeric material layer is formed from a polymeric material which is a fluorinated ethylene propylene polymer.

12. The method according to claim 1 wherein the first polymeric material layer and the second polymeric material layer are formed from a polymeric material comprising reinforcing short and/or milled fibers, reinforcing short and/or milled carbon fibers, nano-carbon fibers, nano-carbon particles, or any mixture thereof.

13. The method according to claim 1 wherein the wellbore cable has an outer diameter from about 0.5 mm to about 400 mm.

* * * * *